US010918216B2

(12) United States Patent
Atkinson, Jr. et al.

(10) Patent No.: US 10,918,216 B2
(45) Date of Patent: Feb. 16, 2021

(54) SYSTEM AND METHOD FOR RAISING A BED OFF THE FLOOR

(71) Applicant: Ronald Neil Atkinson, Jr., Naperville, IL (US)

(72) Inventors: Ronald Neil Atkinson, Jr., Naperville, IL (US); James V. Donato, Arlington Heights, IL (US)

(73) Assignee: Atkinson Ergonomic Solutions, Naperville, IL (US)

( * ) Notice: Subject to any disclaimer, the term of this patent is extended or adjusted under 35 U.S.C. 154(b) by 198 days.

(21) Appl. No.: 15/448,286

(22) Filed: Mar. 2, 2017

(65) Prior Publication Data

US 2017/0251817 A1 Sep. 7, 2017

Related U.S. Application Data

(60) Provisional application No. 62/303,725, filed on Mar. 4, 2016.

(51) Int. Cl.
*A47C 19/04* (2006.01)
*B66F 7/06* (2006.01)
(Continued)

(52) U.S. Cl.
CPC ..... *A47C 19/045* (2013.01); *A47C 19/025* (2013.01); *B66F 7/0641* (2013.01); *B66F 7/28* (2013.01)

(58) Field of Classification Search
CPC ..... A47C 19/12; A47C 19/122; A47C 19/021; A47C 19/025; A47C 19/045; B66F 7/0641; B66F 7/28
See application file for complete search history.

(56) References Cited

U.S. PATENT DOCUMENTS 1,650,810 A 11/1927 Weaver
1,684,606 A 9/1928 Thielen
(Continued)

FOREIGN PATENT DOCUMENTS

EP 2 627 221 A1 8/2013
EP 3 222 170 A1 9/2017
(Continued)

OTHER PUBLICATIONS www.ezimaid.com.au—Archived Web Page from Jan. 11, 2016. Page accessed via www.archive.org on Oct. 24, 2018.

*Primary Examiner* — Peter M. Cuomo
*Assistant Examiner* — Myles A Throop
(74) *Attorney, Agent, or Firm* — Foley & Lardner LLP

(57) ABSTRACT

An apparatus includes a plurality of base plates structured to be positioned on a surface, and a bed frame comprising a plurality of rails configured to receive a bed thereon. A lifting assembly is coupled to each of the base plates and the bed frame. The lifting assembly includes a plurality of lifting members pivotally coupled to base plates and the plurality of rails of the bed frame. A securing mechanism selectively secures at least a portion of the lifting members in a fixed position. The lifting assembly is movable between a first configuration in which the plurality of rails of the bed frame, and thereby the bed positioned thereon, is positioned proximate to the surface, and a second configuration in which the plurality of rails of the bed frame and, thereby the bed are raised off the surface.

15 Claims, 9 Drawing Sheets

(51) Int. Cl.
*B66F 7/28* (2006.01)
*A47C 19/02* (2006.01)

(56) References Cited

U.S. PATENT DOCUMENTS 2,080,963 A 5/1937 Fiedler
2,139,923 A 12/1938 Woller
2,404,577 A 7/1946 Jackson
2,588,509 A 3/1952 Forster
2,793,767 A 5/1957 Smith et al.
2,829,863 A 4/1958 Gibson
3,006,594 A 10/1961 Gruendler
3,109,626 A 11/1963 Arnes et al.
3,190,614 A 6/1965 Evers et al.
3,329,975 A * 7/1967 Hooker ..... A47C 19/04 5/176.1
3,341,868 A 9/1967 Ingildsen
3,516,097 A 6/1970 Angus
3,628,771 A 12/1971 Egeland et al.
3,648,856 A 3/1972 Gaarder et al.
3,746,307 A 7/1973 Yamazaki
3,765,720 A 10/1973 Sakai
3,789,437 A * 2/1974 Garte ..... A47C 19/12 5/610
3,876,096 A 4/1975 Latek
3,887,950 A 6/1975 Wachsman
3,937,443 A 2/1976 Durgan
3,982,767 A 9/1976 Larsson et al.
4,083,599 A 4/1978 Gaffney
4,127,255 A 11/1978 Wooding
4,185,342 A 1/1980 Young
4,194,452 A * 3/1980 Crowther ..... A47B 9/00 108/138
4,494,259 A * 1/1985 Miller ..... A47C 19/045 5/616
4,690,378 A 9/1987 Jarman et al.
4,694,930 A 9/1987 Kishi
4,786,107 A 11/1988 Crockett
4,807,558 A * 2/1989 Swersey ..... G01G 19/445 177/145
4,850,748 A 7/1989 Brink
4,875,555 A 10/1989 Johansson et al.
4,886,242 A 12/1989 Eck et al.
5,020,173 A * 6/1991 Dreyer, Jr. ..... A47C 17/86 297/188.1
5,033,717 A 7/1991 Symon
5,110,090 A 5/1992 McDuffie
5,131,501 A 7/1992 Yoshikawa
5,141,204 A 8/1992 Maros
5,174,548 A 12/1992 Mueller
5,181,694 A 1/1993 Collins
5,190,265 A 3/1993 Barry et al.
5,249,643 A 10/1993 Backer et al.
5,251,875 A 10/1993 Craychee et al.
5,299,779 A 4/1994 Collins
D349,801 S 8/1994 Few et al.
5,429,415 A 7/1995 Meade
5,441,238 A 8/1995 Lindsley, III
5,549,052 A * 8/1996 Hoffman ..... A47B 9/00 108/138
5,641,201 A 6/1997 Casey et al.
5,678,977 A 10/1997 Nordlund
5,730,494 A 3/1998 LaPointe
5,915,671 A 6/1999 Bott
5,990,423 A * 11/1999 Ashpes ..... G01G 23/3728 177/140
6,058,798 A 5/2000 Lantzsch
6,231,120 B1 5/2001 Wiecek
6,253,881 B1 7/2001 Andersson
6,332,232 B1 12/2001 Neal
6,354,570 B1 3/2002 Christensen et al.
6,370,716 B1 4/2002 Wilkinson
6,390,451 B1 5/2002 Baker
6,405,393 B2 6/2002 Megown
6,409,151 B1 6/2002 Cormier
6,412,427 B1 7/2002 Merkt
6,471,187 B1 10/2002 Dubé et al.
6,478,352 B1 11/2002 Fredrickson
6,491,269 B1 12/2002 Larson et al.
6,494,538 B1 12/2002 Alvestad
6,761,524 B2 7/2004 Chabanas et al.
6,974,123 B2 12/2005 Latvys
6,991,199 B2 * 1/2006 Carpentier ..... A47B 9/02 108/144.11
6,997,424 B2 2/2006 Atkinson, Jr.
7,347,410 B2 3/2008 Atkinson, Jr.
7,743,440 B2 6/2010 Burnett
7,757,313 B2 7/2010 Koorey
7,941,879 B2 5/2011 Burnett
8,739,329 B2 6/2014 Koorey
9,049,923 B1 * 6/2015 Delagey ..... A47B 9/18
9,265,351 B2 2/2016 Koorey
9,615,655 B1 * 4/2017 Huang ..... A47B 9/16
9,743,776 B2 8/2017 Ray
2004/0183276 A1 * 9/2004 Silva ..... A61G 5/1059 280/657
2005/0172405 A1 * 8/2005 Menkedick ..... A61B 5/1115 5/618
2006/0026767 A1 * 2/2006 Chambers ..... A61G 7/0507 5/713
2013/0014675 A1 * 1/2013 Burkhalter ..... A47B 7/02 108/50.11
2013/0139736 A1 * 6/2013 Flaherty ..... A47B 9/18 108/106

FOREIGN PATENT DOCUMENTS

FR 2602655 2/1988
FR 3049179 9/2017

* cited by examiner

SYSTEM AND METHOD FOR RAISING A BED OFF THE FLOOR

CROSS REFERENCE TO RELATED APPLICATIONS

The present application claims the benefit of priority to U.S. Provisional Application No. 62/303,725, filed Mar. 4, 2016, and the contents of which are incorporated herein by reference in its entirety.

TECHNICAL FIELD

The present disclosure relates generally to lifting assemblies for raising or lifting a bed off a floor.

BACKGROUND

Most beds include a bed frame on which a mattress and optionally, a box spring is disposed. The bed may also include bed sheets, pillows, comforters, etc. disposed on the mattress. The mattress and the box spring generally have a relatively significant weight. However, there are many situations in which at least a portion of the mattress and/or box spring may have to be lifted off the floor. For example, a person changing a bed sheet of the mattress often has to bend over to change sheets or otherwise make the bed. Bending over frequently and/or for extended periods of time may pose a number of safety and health issues. For example, the bending over may cause strain on the back and hands of the person making the bed (e.g., changing the sheets of the mattress). For example, in hotels and resorts, hospitality personnel or custodians may have to change numerous bed sheets on any given day. The repetitive bending over to change the bed sheets may cause severe injuries over time to the back, legs and/or hands of the persons changing the bed sheets.

SUMMARY

Embodiments described herein relate generally to systems and methods for raising or lifting a bed frame and a bed including a box spring and/or a mattress off or upwards from a surface and in particular, to a lifting assembly configured to be coupled to a bed frame on which the box spring and/or mattress is positioned. The lifting assembly is configured to selectively move the box spring and/or mattress so that the bed frame and, thereby the box spring and/or mattress is lifted upwards from the surface, for example the floor.

In a first set of embodiments, an apparatus comprises a plurality of base plates positioned on a surface. The apparatus also comprises a bed frame which includes a plurality of rails structure to receive a bed thereon. The bed includes at least one of a box spring and a mattress. The apparatus also comprises a lifting assembly coupled to each of the plurality of base plates and the bed frame. The lifting assembly comprises a plurality of lifting members. Each of the plurality of lifting members has a lifting member first end and a lifting member second end. The lifting member first end is pivotally coupled to at least one of the plurality of base plates, and the lifting member second end is pivotally coupled to at least one of the plurality of rails of the bed frame. A securing mechanism selectively secures at least a portion of the plurality of lifting members in a fixed position. The lifting assembly is movable between a first configuration and a second configuration. In the first configuration, the lifting member second end of each of the plurality of lifting members is positioned proximate to the plurality of base plates such that the plurality of rails of the bed frame, and thereby the bed positioned thereon, is positioned proximate to the surface. In the second configuration, the lifting member second end of each of the plurality of lifting members is positioned distal to the plurality of base plates so that the plurality of rails of the bed frame and, thereby the bed is raised off the surface.

In a second set of embodiments, a lifting assembly comprises a plurality of lifting members configured to be coupled to a plurality of base plates positioned on a surface and a bed frame configured to receive a bed thereon. The bed frame includes a plurality of rails. Each of the plurality of lifting members have a lifting member first end and a lifting member second end. The lifting member first end is configured to be pivotally coupled to the bed frame, and the lifting member second end is pivotally coupled to at least one of the plurality of rails. A securing mechanism selectively secures at least a portion of the plurality of lifting members in a fixed position. The lifting assembly is movable between a first configuration and a second configuration. In the first configuration, the lifting member second end of each of the plurality of lifting members is positioned proximate to the plurality of base plates such that the plurality of rails of the bed frame, and thereby the bed positioned thereon, is positioned proximate to the surface. In the second configuration, the lifting member second end of each of the plurality of lifting members is positioned distal to the plurality of base plates so that the plurality of rails of the bed frame and, thereby the bed is raised off the surface.

It should be appreciated that all combinations of the foregoing concepts and additional concepts discussed in greater detail below (provided such concepts are not mutually inconsistent) are contemplated as being part of the subject matter disclosed herein. In particular, all combinations of claimed subject matter appearing at the end of this disclosure are contemplated as being part of the subject matter disclosed herein.

BRIEF DESCRIPTION OF DRAWINGS

The foregoing and other features of the present disclosure will become more fully apparent from the following description and appended claims, taken in conjunction with the accompanying drawings. Understanding that these drawings depict only several implementations in accordance with the disclosure and are therefore, not to be considered limiting of its scope, the disclosure will be described with additional specificity and detail through use of the accompanying drawings.

Figure 1:
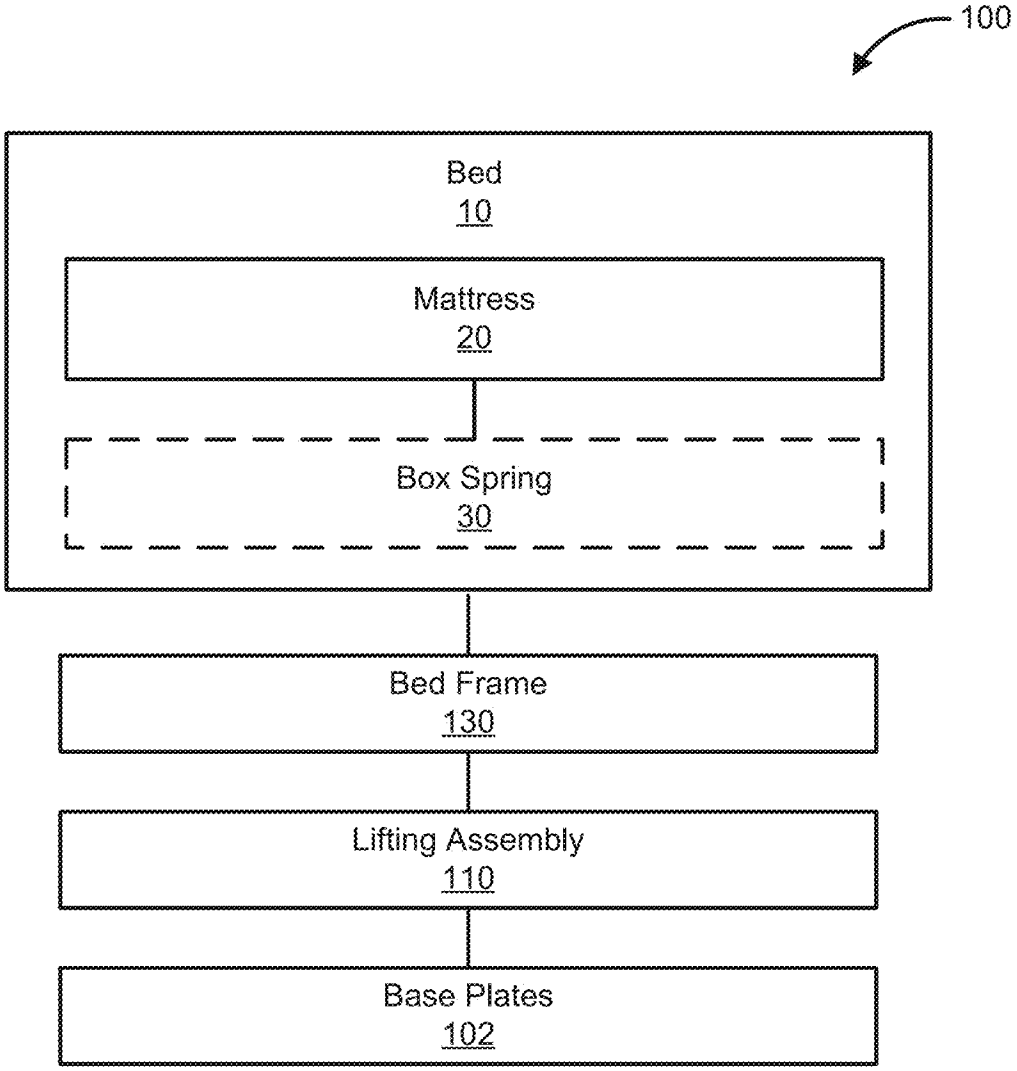
FIG. 1 is a schematic block diagram of an apparatus that includes a lifting assembly for raising or lifting a beds upwards from a surface on which the apparatus is positioned.

Reference is made to the accompanying drawings throughout the following detailed description. In the drawings, similar symbols typically identify similar components, unless context dictates otherwise. The illustrative implementations described in the detailed description, drawings, and claims are not meant to be limiting. Other implementations may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and made part of this disclosure.

DETAILED DESCRIPTION OF VARIOUS EMBODIMENTS

Embodiments described herein relate generally to systems and methods for raising or lifting a bed frame and a bed including a box spring and/or a mattress off or upwards from a surface and in particular, to a lifting assembly configured to be coupled to a bed frame on which the box spring and/or mattress is positioned. The lifting assembly is configured to selectively move the box spring and/or mattress so that the bed frame and, thereby the box spring and/or mattress is lifted upwards from the surface, for example the floor. Most beds include a bed frame on which a box spring and/or a mattress is disposed. The bed may also include bed sheets, pillows, comforters, etc. disposed on the mattress. For example, a person changing a bed sheet of the mattress often has to bend over so as to make the bed. However, the manual making of the bed (e.g., the bed frame, the box spring and/or mattress) while bending over may pose a number of safety and health issues. For example, frequent or excessive bending over can cause strain on the back and hands of the person making the mattress. The health and safety concern is even higher in settings where bed sheets of mattresses have to be repeatedly changed. For example, in hotel hospitality personnel may have to change numerous bed sheets on any given day.

Various embodiments of the systems and methods of lifting a box spring and/or a mattress upwards from a bed frame described herein for may provide benefits including, for example: (1) allowing selective raising or lifting of a bed frame off a surface so as to lift a bed (e.g., a box spring and/or mattress) positioned on the bed frame of the surface (e.g., the floor) with significantly reduced effort so as to allow a person to facilely change a bed sheet without having to bend over; (2) securing the lifting assembly in a fixed position in each of a first configuration, in which the bed frame and bed are positioned proximate to the surface, and a second configuration in which the bed frame and the bed are raised or lifted off the surface (e.g., upwards from the surface), thereby preventing accidental dropping of the box spring and/or the mattress; (3) providing assistance in lifting the bed frame via a biasing force exerted by a biasing member included in the lifting assembly; and (4) damping the motion of the lifting assembly via a damper included in the lifting assembly, when the bed frame is moved towards the floor so as to prevent slamming of the bed frame on to the floor or a plurality of base plates positioned on the floor.

FIG. 1 is a schematic block diagram of an apparatus 100 according to an embodiment. The apparatus 100 may include a plurality of base plates 102, a lifting assembly 110, a bed frame 130 and a bed 10 positioned on the bed frame.

The plurality of base plates 102 may include flat or rigid plates configured to bear a weight of the lifting assembly 110, the bed frame 130 and the bed 10 positioned thereon. In some embodiments, the plurality of base plates 102 may include flat or rigid plates configured to bear a weight of the lifting assembly 110, the bed frame 130 and the bed 10 positioned thereon. In some embodiments, the plurality of base plates 102 may also be coupled to the plurality of base plates, for example to provide additional mechanical rigidity and strength, as described herein. In some embodiments, a plurality of decorative boards (e.g., side boards, a back board and/or a front board) may be positioned around the plurality of base plates, for example for aesthetic reasons. In particular embodiments, the side board may be coupled to the plurality of base plates. The decorative boards may comprise wooden boards, metal boards or any other suitable boards. It is to be noted that the decorative boards only provided for aesthetic purposes and do not form any structural or functional component of the apparatus 100.

The bed 10 includes a mattress 20 and/or a box spring 30 and may also include other components, for example slats, pillows, bed sheets, decorative sheets, comforters etc. The bed frame 130 includes a plurality of rails structured to receive the bed 10 thereon. The plurality of rails may comprise a rail first portion positioned substantially parallel to a surface on which the plurality of base plates 102 are positioned, and configured to receive the bed 10 thereon. A rail second portion may be positioned orthogonal to the first portion and configured to overlap a portion of a sidewall of the bed 10 (e.g., the mattress 20 and/or the box spring 30) so as to prevent the bed 10 from sliding off the plurality of rails. In some embodiments, the bed frame 130 may also include a plurality of rail cross members may be coupled to opposing rails of the plurality of rails and positioned orthogonal thereto so as to provide mechanical strength and structural rigidity for receiving the bed 10 thereon.

The mattress 20 may include any suitable mattress such as for example a spring mattress, a foam mattress, a memory foam mattress, a gel mattress, a water mattress, an air mattress or any other suitable mattress. The mattress 20 may have any suitable size, for example single, twin, full, queen, king or any other suitable shape or size.

In some embodiments, a box spring 30 is positioned on the bed frame 130 and the mattress 20 is positioned on the box spring 30. The box spring 30 may comprise any suitable box spring, for example a wooden box spring or any other commonly available box spring. In other embodiments, the box spring 30 may be excluded such that the mattress 20 may be positioned directly on the bed frame 130 and/or a portion of a lifting assembly 110 coupled to the bed frame 130. In such embodiments, slats (e.g., wooden slats) may be positioned on the bed frame 130 and the mattress 20 positioned thereon.

The lifting assembly 110 is coupled to each of the plurality of base plates 102 and the bed frame 130 and comprises a plurality of lifting members. Each of the plurality of lifting members may have a lifting member first end and a lifting member second end. The lifting member first end may be pivotally coupled to at least one of the plurality of base plates 102 and the lifting member second end may be pivotally coupled to at least one of the plurality of rails of the bed frame 130.

The lifting assembly 110 is movable between a first configuration and a second configuration. In the first configuration, the lifting member second end of each of the plurality of lifting members are positioned proximate to the plurality of base plates 102 such that the plurality of rails of the bed frame 130, and thereby the bed 10 positioned thereon, is positioned proximate to the surface (e.g., the floor) on which the plurality of base plates 102 are positioned. In the second configuration, the lifting member second end of each of the plurality of lifting members is positioned distal to the plurality of base plates 102 so that the plurality of rails of the bed frame and, thereby the bed 10 positioned thereon are raised or lifted upwards off the surface on which the plurality of base plates 102 are positioned.

In some embodiments, the lifting assembly 110 may include a plurality of cross-members coupled to and positioned orthogonal to opposing lifting members of the plurality of lifting members. The cross-members may provide structural rigidity and support to the lifting members for lifting the bed frame 130 and, thereby the bed 10 upwards off from the surface.

In some embodiments, a length of each of the plurality of cross-members is adjustable so as to adjust a spacing between the plurality of lifting members to correspond to a width of the bed frame 130 and, thereby the bed 10 positioned thereon. For example, the plurality of cross-members may allow adjusting of a spacing between opposing lifting members and, thereby the plurality of base plates 102 so as to correspond to a width of the bed frame 130 such that the lifting assembly 110 may be usable with any bed frame 130 and, thereby bed 10 having any suitable width or size.

The lifting assembly 110 may also include a securing mechanism selectively securing at least a portion of the plurality of lifting members in a fixed position. For example, the securing mechanism may be structured to fixedly secure at least the portion of the plurality of lifting members in each of the first configuration and the second configuration.

In some embodiments, at least the portion of the lifting members include a plurality of apertures, and the securing mechanism may include a locking pin. The locking pin may be structured to engage at least one of the plurality of apertures in each of the first configuration and the second configuration so as to fixedly secure at least the portion of the lifting members. In other embodiments, the securing mechanism may comprise a latch, a rack and pinion, slots, grooves, notches, friction fit or any other securing mechanism for securing the portion of the lifting members in each of the first configuration and the second configuration.

In particular embodiments, the lifting assembly 110 may include a latch and/or a knob. The latch and/or the knob may be structured to be selectively engaged by a user so as to release the at least the portion of the plurality of lifting members from the securing mechanism. For example, a cable may be provided for operatively coupling the latch and/or the knob to the securing mechanism. A user may engage the latch and/or the knob so as to release the portion of the plurality of lifting members (e.g., the aperture of the portion of the lifting members engaged by the locking pin), thereby allowing the lifting members to be rotated about the lifting member first end so as to bed frame 130 and, thereby the bed 10 off the surface (e.g., the floor).

In some embodiments, the lifting assembly may also include at least one damper having a damper first end and a damper second end. In various embodiments, the damper may comprise a shock absorber, for example a hydraulic shock absorber, a twin tube shock absorber, a mono tube shock absorber, a gas shock absorber or any other suitable damper.

The damper first end may be coupled to a corresponding base plate of the plurality of base plates of the bed frame 101, and the damper second may be coupled to a first set of the plurality of lifting members of the lifting assembly 110. The at least one damper is configured to exert a damping force on the first set of lifting members so as to limit a velocity of the lifting assembly 110 as it is being moved from the second configuration into the first configuration.

In some embodiments, the lifting assembly 110 may further comprise at least one biasing member having a biasing member first end and a biasing member second end operatively coupled to at least one lifting member of the plurality of lifting members as described herein. The biasing member may be configured to exert a biasing force in a first biasing direction (e.g., pull on the lifting member) to effectively rotate the lifting member. In other embodiments, the biasing member may be configured to exert a biasing force in a second biasing direction (e.g., push the lifting member) to effectively rotate the lifting member. The one or more biasing members configured to exert the force in the first biasing direction may include, for example, a tension spring, a helical spring, an extension spring, a bungee cord or any other biasing member. The one or more biasing members configured to exert the force in the second biasing direction may include, for example, a compression spring, a helical spring, a gas spring or any other biasing member.

The biasing member first end of the at least one biasing member may be coupled to a corresponding base plate of the plurality of base plates 102 or otherwise a decorative board positioned around the plurality of base plates 102. Furthermore, the biasing member second end of the at least one biasing member may be coupled to a second set of the plurality of lifting member. The at least one biasing member may be configured to exert a biasing force on the second set of lifting members so as to urge the lifting assembly 110 towards the second configuration.

A preloading member may be operatively coupled to the at least one biasing member. The preloading member is configured to adjust the biasing force exerted by the one or more biasing members. For example, the preloading member may comprise a slidable or otherwise movable coupling and configured to move the coupling location of the biasing member first end closer or further away from the biasing member second end. In the case of the biasing member configured to exert a biasing force in the first biasing direction to effectively rotate the lifting member, this may adjust a preload in the biasing member (e.g., a tension spring) by extending or shortening a length of the biasing member, thereby adjusting a biasing force exerted by the biasing member on the second set of the lifting members. In the case of the biasing member configured to exert the biasing force in the second biasing direction to effectively rotate the lifting member this may adjust a preload in the biasing member (e.g., a compression spring) by extending or shortening a length of the biasing member, thereby adjusting the second biasing force exerted by the biasing member on the second set of the lifting members.

Figure 2A:
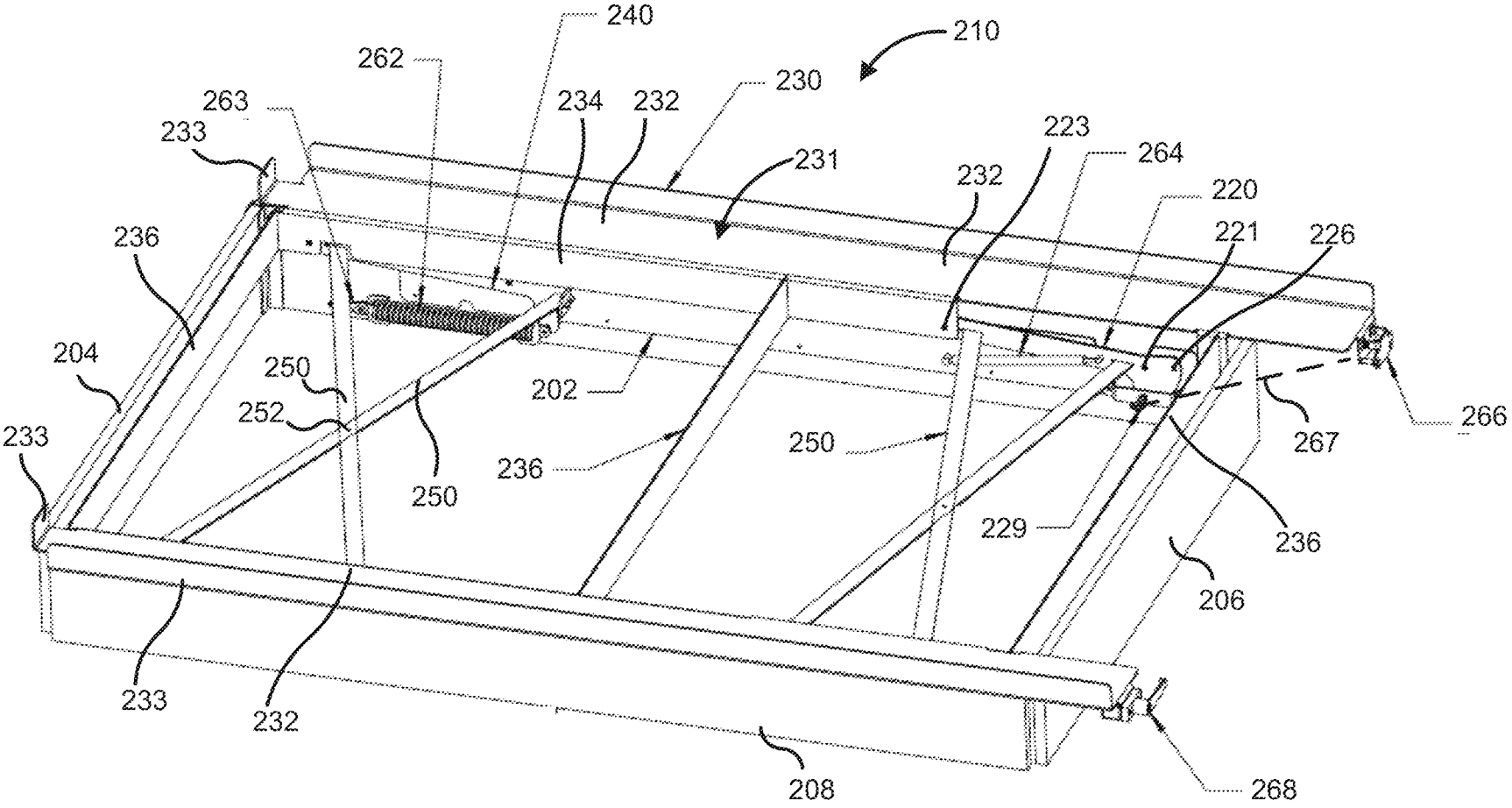
FIG. 2A is a top, front, left perspective view of an embodiment of an apparatus including a plurality of base plates, a lifting assembly and a bed frame in a first configuration.
Figure 2B:
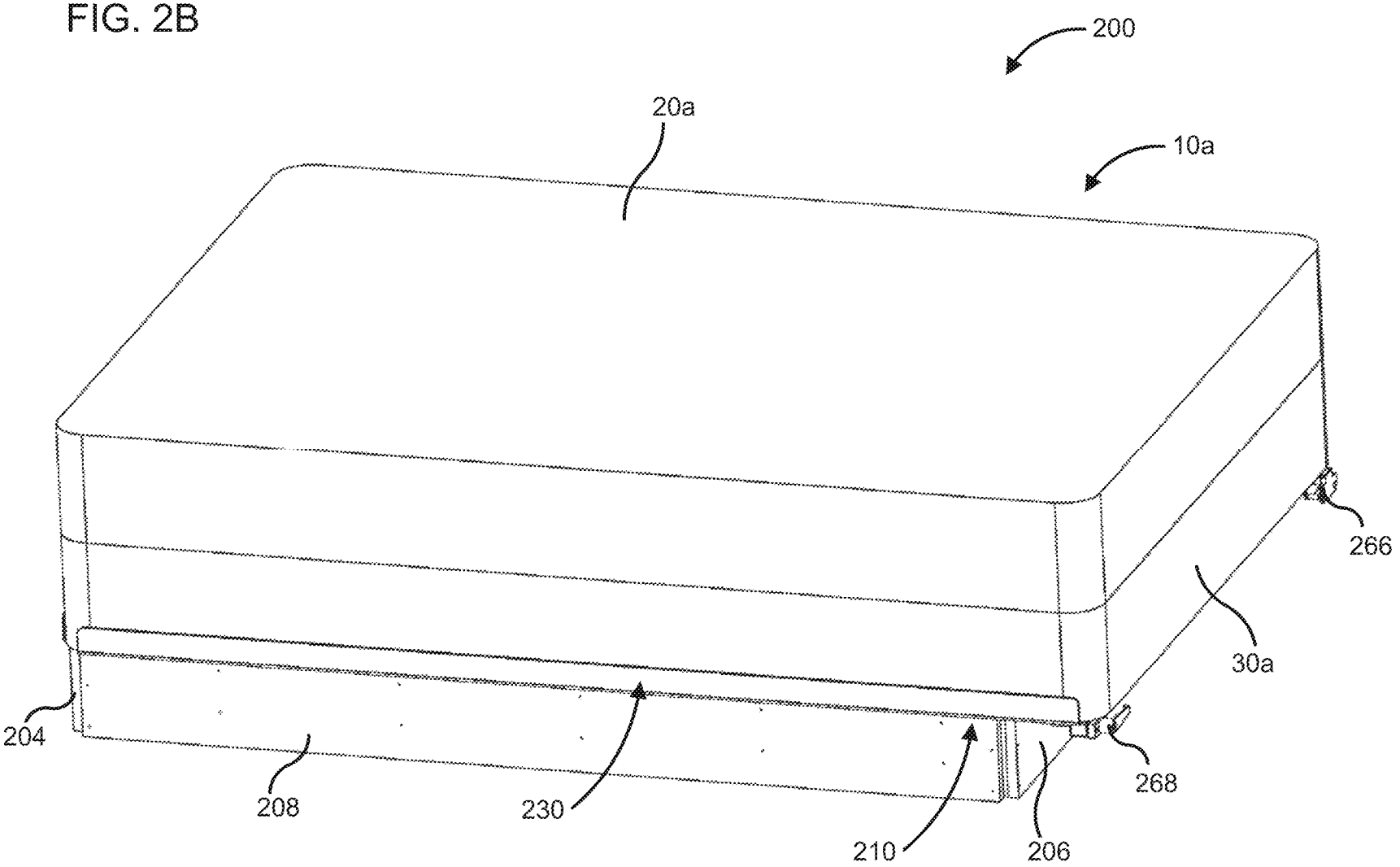
FIG. 2B is another perspective view of the lifting assembly and bed frame of FIG. 2B with a bed including a box spring and a mattress positioned thereon.
Figure 3A:
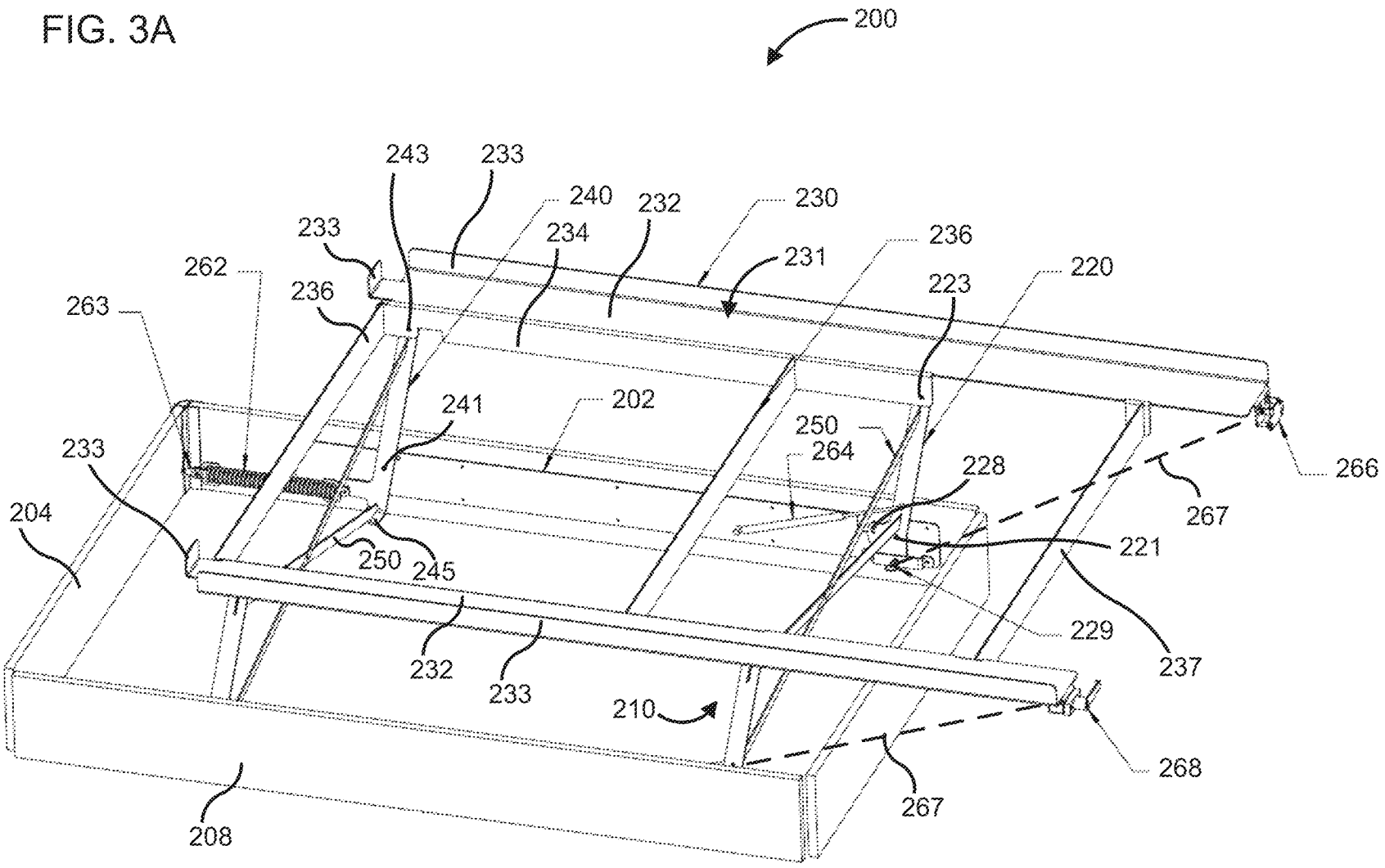
FIG. 3A is top, front left perspective view of the apparatus of FIG. 2 in a second configuration.
Figure 3B:
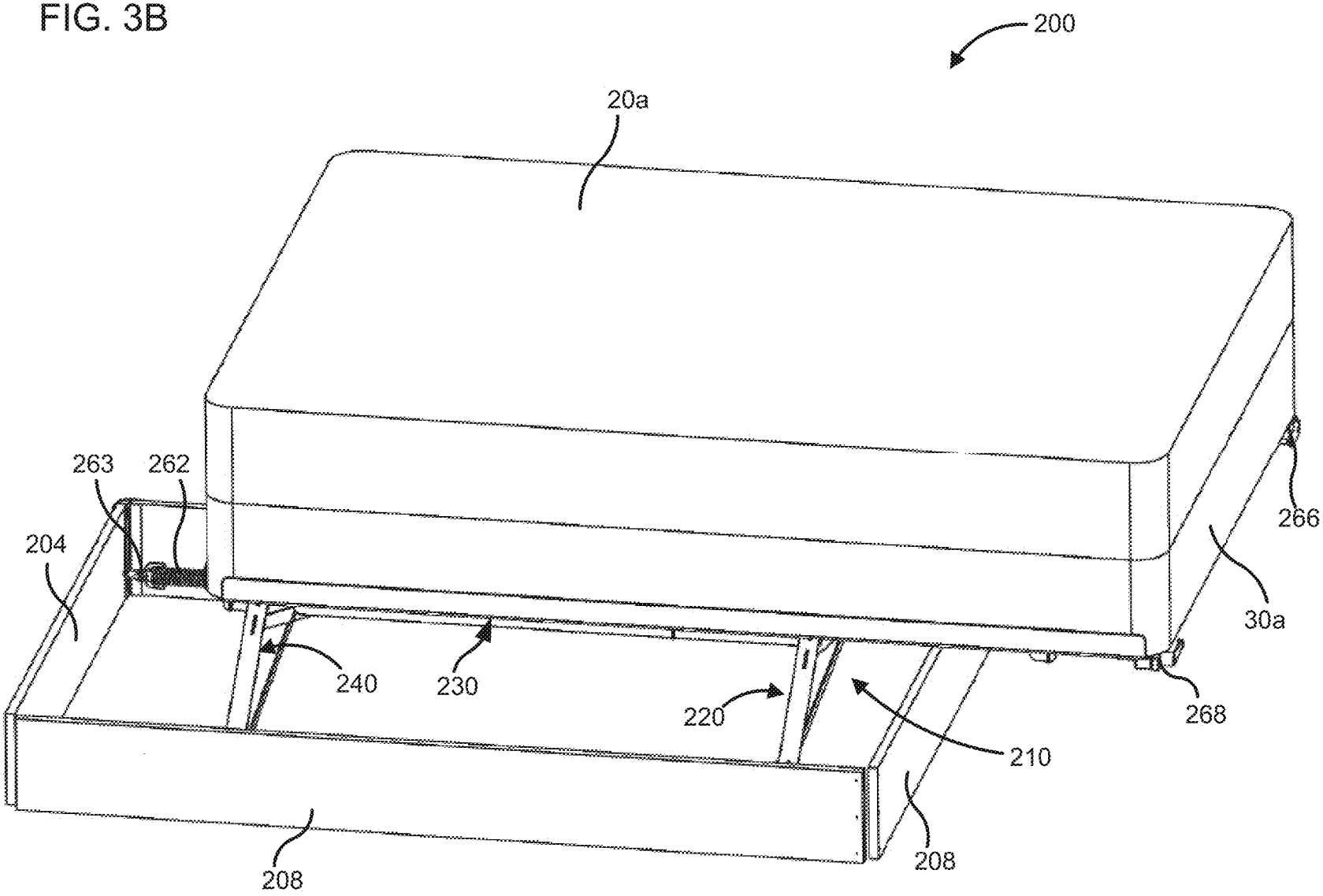
FIG. 3B is another perspective view of the lifting assembly and bed frame of FIG. 3B with a box spring and a mattress positioned thereon.
Figure 4:
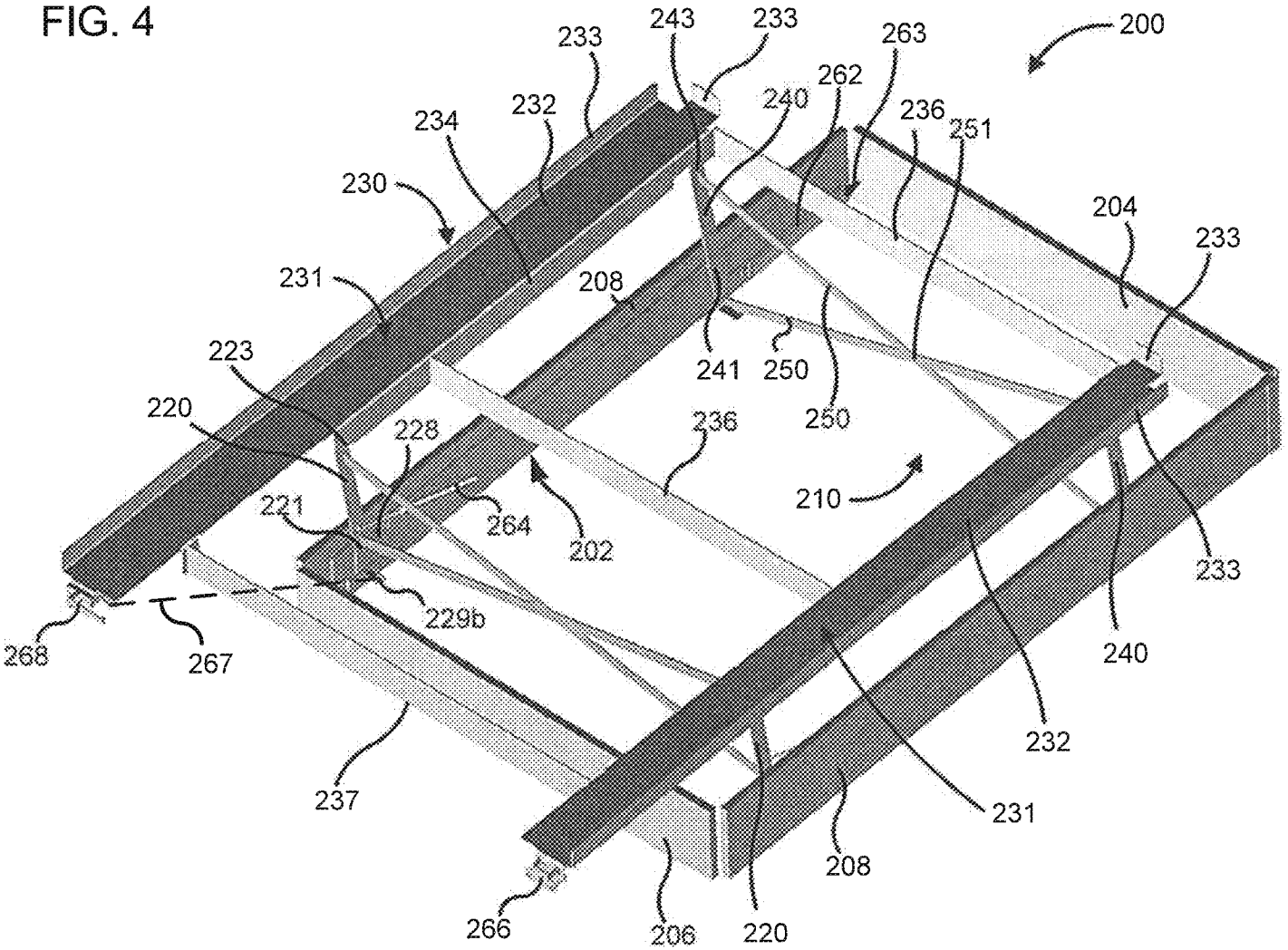
FIG. 4 is a top, front, right perspective view of the apparatus of FIGS. 3A-B.

FIGS. 2A-B, 3A-B and 4 are perspective views of another embodiment of an apparatus 200 that includes a lifting assembly 210 in a first configuration (FIGS. 2A-B) and a second configuration (FIGS. 3A-B and FIG. 4). The apparatus includes a plurality of base plates 202, a bed frame 230 and a lifting assembly 210 is coupled to the each of the plurality of based plates 202 and the bed frame 230. The lifting assembly 210 comprises a first set of lifting members 220, a second set of lifting members 240, a plurality of cross-members 250, a plurality of biasing members 262, a plurality of dampers 264, a latch 266 and optionally, a knob 268.

The plurality of base plates 202 are configured to be positioned on a surface, for example the floor. The plurality of base plates 202 may include flat plates formed from a strong and rigid material (e.g., metals such as cast iron or stainless steel). In some embodiments, a plurality of decorative boards may be positioned around the plurality of base plates 202, for example to prevent a user from seeing the plurality of base plates 202 and/or the lifting assembly 210 (e.g., for aesthetic purposes).

For example as shown in FIGS. 2A-B, 3A-B and 4, the decorative boards may include a back board 204, a front board 206 and a pair of side boards 208 positioned on either side of the plurality of base plates 202. The back board 204 is coupled to a side board first end of the side boards 208, and the front board 206 is coupled to a side board second end of the side boards 208 opposite the first end, such that the side boards 208 are positioned orthogonal (e.g., at an angle in the range of 85 degrees to 95 degrees inclusive of all ranges and values therebetween) to the back board 204 and the front board 206. The back board 204, the front board 206 the side boards 208 may be formed from wood, engineered woods, metal, plastics, metals or any suitable material. It should be appreciated that while FIGS. 2A-B, 3A-B and 4 show a particular type of decorative boards any other decorative boards may be positioned around the plurality of base plates 202 and/or coupled thereto.

As shown in FIGS. 2A-B, 3A-B and 4, the plurality of base plates 202 are coupled to an inner surface of the opposing side boards 208 of the pair of side boards 208. The base plates 202 may be coupled to the corresponding side boards 208 using any suitable method, for example fasteners (e.g., screws, nuts, bolts, rivets, pins, etc.). In other embodiments, the plurality of base plates 202 of the bed frame 201 may be positioned on the surface (e.g., the floor). In such embodiments, the plurality of base plates 202 may not be coupled to the pair of side boards such that the back board 204, the front board 206 and the pair of side boards 208. It is to be noted that the decorative boards only provided for aesthetic purposes and do not form any structural or functional component of the apparatus 200.

The bed frame 230 comprises a plurality of rails 231 structured to receive a bed 10*a* thereon as shown in FIGS. 2B and 3B. The bed 10*a* includes a box spring 30*a* positioned on the bed frame 230 and a mattress 20*a* positioned on the bed frame 230. The mattress 20*a* and the box spring 30*a* may be substantially similar to the mattress 20 and box spring 30 described with respect to FIG. 1 and are therefore not described in further detail herein. In various embodiments, the bed 10*a* may also include slats, pillows, bed sheets, decorative sheets, comforters etc.

The plurality of rails 231 of the bed frame 230 may include a pair of opposing rails 231 spaced apart from each other by a distance corresponding to a width of the mattress 20*a* and/or the box spring 30*a* which is to be positioned on the rails 231. The plurality of rails 231 of the bed frame 230 are movably coupled to corresponding base plates 202 of the plurality of base plates 202 via the first set of lifting members 220 and the second set of lifting members 240, as described herein.

The plurality of rails 231 may include a rail first portion 232 positioned substantially parallel to a floor on which the plurality of base plates 202 are positioned and configured to receive the mattress 20*a* or the box spring 30*a* thereon. A rail second portion 233 may be positioned orthogonal (e.g., at an angle in the range of 85 to 95 degrees inclusive of all ranges and values therebetween) to the rail first portion 232 and extends from a first side of the rail first portion 232 away from the plurality of base plates 202. For example, the rail second portion 233 may include sidewalls positioned orthogonal to the rail first portion 232 and configured to overlap a portion of a sidewall of the box spring 30*a* and/or the mattress 20*a* positioned on the rail first portion 232 so as to prevent the box spring 30*a* and/or the mattress 20*a* from sliding off the rails 231 of the bed frame 230.

In particular embodiments, the plurality of rails 231 may also include a rail third portion 234 extending orthogonally (e.g., at an angle in the range of 85 to 95 degrees inclusive of all ranges and values therebetween) away from a second side of the rail first portion 232 towards the plurality of base plates 202. The second side of the rail first portion 232 may be located opposite the first side of the rail first portion 232. A lifting member second end 223/243 of each of the first set of lifting members 220 and the second set of lifting members 240 may be coupled to the rail third portion 234 as described herein.

In some embodiments, a plurality of rail cross-members 236 may be coupled to opposing rails 231 of the plurality of rails 231 and positioned orthogonal thereto so as to provide mechanical strength and structural rigidity for receiving the bed 10*a* thereon. For example, as shown in FIGS. 2-4 opposing ends of the plurality of rail cross-members 236 are coupled to the rail third portion 234 of the opposing rails 231. In particular embodiments, the plurality of rail cross-members 236 may be oriented at any suitable angle with respect to the plurality of rails 230, for example an angle of 30, 40, 50, 60, 70, 80, 90, 100, 110 120, 130, 140 or 150 degrees inclusive of all ranges and values therebetween.

In some embodiments, the plurality of rail cross-members 236 may have a fixed length. For example, the lifting assembly 210 may be fixedly coupled to the bed frame 230 and a length of the plurality of rail cross-members 236 may correspond to a width of the bed frame 230 (i.e., a spacing between the plurality of 231 of the bed frame 230), and thereby the bed 10*a*. In other embodiments, the length of each of the plurality of rail cross-members 236 may be adjustable. The length of the plurality of rail cross members 236 may be lengthened or shortened so as to correspond to a width of the bed frame 230 and, thereby the box spring 30*a* and/or the mattress 20*a* positioned on the bed frame 230.

The lifting assembly 210 is coupled to each of the plurality of base plates 202 and the bed frame 230. The lifting assembly 210 includes a first set of lifting members 220 and a second set of lifting members 240 (collectively referred to herein as "the lifting members 220/240). The first set of lifting members 220 are positioned proximate to a base plate second end of the plurality of base plates 202 proximate to the front board 206 and the second set of lifting members 240 are positioned proximate to a base plate first end of the plurality of base plates 202 proximate to the back board 204.

The lifting members 220/240 include a lifting member first end 221/241 and a lifting member second end 223/243. The lifting member first end 221/241 of the lifting members 220/240 may be pivotally coupled to a corresponding base plate 202 of the plurality of base plates 202. Furthermore, the second end 223/243 of the lifting members 220/240 may be pivotally coupled to a corresponding rail 231 of the plurality of rails 231 of the bed frame 230, for example the rail third portion 234 of the plurality of rails 231.

The lifting assembly 210 is movable between a first configuration and a second configuration. In the first configuration (FIGS. 2A-B), the lifting member second end 223/243 of the plurality of lifting members 220/240 is positioned proximate to the base plates 202, for example substantially parallel to the corresponding base plate 202 such that the bed frame 230 is positioned proximate to the plurality of base plats 202, and thereby a surface (e.g., the floor) on which the plurality of base plates 202 are positioned.

To move into the second configuration (FIGS. 3A-B and 4), the lifting members 220/240 pivot about the lifting member first end 221/241 such that the lifting member second end 223/243 rotates relative to the lifting member first end 221/241 (e.g., in a clockwise direction). The movement of the lifting members 220/240 towards the second configuration may be initiated by pulling upwards on the bed frame 230 (e.g., the plurality of rails 231) or on the bed 10*a* (e.g., the box spring 30*a* and/or the mattress 20*a*) positioned thereon. The first set of lifting members 220 and/or the second set of lifting members 240 may also include a protrusion 245 positioned at the lifting member first end 221/241. The protrusion 245 may be configured to engage the corresponding base plate 202 in the second configuration so as to limit the rotation of the lifting members 220/240 about the lifting member first end 221/241.

The lifting members 220/240 are rotated until the lifting member second end 223/243, and thereby a section of the lifting members 220/240 is positioned distal to the plurality of base plates 202 so as to move the lifting assembly 210 into the second configuration. The angular rotation of the lifting members 220/240 causes the lifting members 220/240 to lift or raise the bed frame 230 and, thereby the bed 10*a* (e.g., the box spring 30*a* and/or the mattress 20*a*) positioned off the surface on which the plurality of base plates 202 are positioned. In the second configuration at least a section of the plurality of lifting members 220/240 is positioned above the plurality of base plates 202 so that the plurality of rails 231 of the bed frame 230 and, thereby the bed 10*a* positioned thereon, are lifted upwards relative to the plurality of base plates 102, and thereby the surface on which the plurality of base plates 202 are positioned.

In various embodiments the lifting members 220/240 may be rotatable at an angle of greater than 90 degrees about the lifting member first end 221/241 when transitioning the lifting assembly 210 from the first configuration towards the second configuration. This causes the bed frame 230 and, thereby the bed 10*a* which may be positioned thereon, not only to move (i.e., raised) upwards from the plurality of base plates 202, and thereby upwards from the surface, but also away from the back board 204 and towards the front board 206. This allows a portion of the bed 10*a* (e.g., the box spring 30*a* and/or the mattress 20*a* positioned proximate to the back board 204) to be accessible by a user, thereby facilitating positioning of a bed sheet on and around the mattress 20*a* or otherwise making the bed, respectively without needing to bend down.

The lifting assembly 210 also includes a securing mechanism 229 selectively securing at least a portion of the first set of lifting members 220 in a fixed position in each of the first configuration and the second configuration. In some embodiments, the securing mechanism 229 may be coupled to the bed frame 230, for example any one of the plurality of rails 231 of the bed frame 230. Expanding further, the first set of lifting members 220 may include a first aperture 226 (see FIGS. 3A-B and 4) and a second aperture 228 (see FIG. 2A-B) defined on the lifting member first end 221 of the first set of lifting members 220. In other embodiments, the first aperture 226 and the second aperture 228 may be defined on any other portion of the first set of lifting members 220 and/or the second set of lifting members 240. The securing mechanism 229 may include a locking pin structured to engage the first aperture 226 in the first configuration and engage the second aperture 228 in the second configuration. In various embodiments, the locking pin may include a spring, for example to urge the locking pin into the first aperture 226 and the second aperture 228 when they are aligned with the locking pin in the first configuration and the second configuration, respectively.

For example, the securing mechanism 229 (e.g., the locking pin) may be selectively positioned through the first aperture 226 in the first configuration so as to prevent the first set of lifting members 220 from rotating, thereby fixedly securing the first set of lifting members in the first configuration. The securing mechanism (e.g., a lock pin) may be removed from the first aperture 226 to allow rotation of the first set of lifting members 220 so as to move the lifting assembly 210 into the second configuration.

In the second configuration, the second aperture 228 may be aligned with the securing mechanism 229 so that the securing mechanism 229 engages the first set of lifting members 220 (e.g., the locking pin is positioned through the second aperture 228). In this manner, the securing mechanism 229 fixedly secures the first set of lifting members 220 and, thereby the lifting assembly 210 in each of the first configuration and the second configuration. This prevents inadvertent or accidental movement between the first and second configurations and serves as a safety feature for users operating the lifting assembly 210 or to prevent minors from operating the lifting assembly 210.

In particular embodiments, the lifting assembly 110 may include a latch 266 and/or a knob 268. The latch 266 may include a clip or a plate operatively coupled to a corresponding securing mechanism 229 (e.g., a locking pin), for example via a flexible cable 267. The latch 266 may be positioned on a first end of a first rail 210 of the plurality of rails 230, the first end being proximate to the front board 206. A user may engage the latch 266, for example pull on the latch 266, which causes the flexible cable 267 to pull on the securing mechanism 229 (e.g., the locking pin) so as to release the first set of lifting members 220 from the corresponding securing mechanism 229 (e.g., pull the locking pin out of the first aperture 226 or the second aperture 228). In some embodiments, the latch 266 may be positioned at any other suitable location of the bed frame 230. The latch 266 may include a key-lock cylinder. The key-lock cylinder being an added security measure to prevent unauthorized use of the product.

In some embodiments, the lifting assembly 210 also includes a knob 268. The knob 268 may comprise a handle and/or a key-lock cylinder. The knob 268 may be operatively coupled to a corresponding securing mechanism 229 (e.g., a locking pin) via a corresponding cable 267. The knob 268 may be positioned on a second end of a second rail 230 of the plurality of rails 230 of the bed frame, the second end being proximate to the front board 206. A user may selectively rotate the knob (e.g., a rotatable handle) to cause the cable 267 so as to release the corresponding lifting member 220 included in the first set of lifting members 220 from the securing mechanism 229, as described with respect to the latch 266. In some embodiments, the knob 268 may be positioned at any other suitable location of the bed frame 230.

As described before, the knob 268 may include a key-lock cylinder or any other suitable locking mechanism. A user may lock the knob 268 via a key so as to prevent an unauthorized person from turning the knob so as to free the first set of lifting members 220 from the securing mechanism 229. The user may the selectively unlock the knob 268 so as to allow the knob 268 to be rotated for releasing the corresponding first set of lifting members 220 from the securing mechanism, as described herein.

A damper 264 is operatively coupled to each of the first set of lifting members 220. The damper 264 includes a damper first end and a damper second end. In various embodiments, the damper 264 may include a shock absorber, for example a hydraulic shock absorber, a twin tube shock absorber, a mono tube shock absorber, a gas shock absorber or any other suitable damper.

The damper first end is coupled to a corresponding base plate 202 of the plurality of base plates 202. The damper second end is coupled to the first set of lifting members 220. The damper 264 is configured to exert a damping force on the first set of lifting members 220 so as to limit a velocity of the lifting assembly 210 as it is being moved from the second configuration towards the first configuration.

A biasing member 262 is operatively coupled to each of the second set of lifting members 240. The biasing member 262 may comprise, for example, a tension spring, a helical spring, an extension spring, a bungee cord or any other biasing member. The biasing member 262 includes a biasing member first end and a biasing member second end. The biasing member first end may be coupled to a corresponding base plate 202 or any one of the decorative boards (e.g., a corresponding side board 208). Furthermore, the biasing member second end may be coupled to the second set of lifting member 240. The biasing member 262 may be configured to exert a biasing force on the second set of lifting members 240 so as to urge the lifting assembly 210 towards the second configuration.

For example, in the first configuration (FIGS. 2A-B), the lifting member first end 241 of the second set of lifting members 240 is rotated about its pivot mount away from the biasing member 262 such that the biasing member 262 (e.g., tension spring or bungee cord) is stretched or extended. The extension or stretching of the biasing member 262 causes the biasing member 262 to store potential energy which exerts the biasing force on the first end 241 of the second set of lifting members 240.

Once the securing mechanism 229 releases the first set of lifting members 220, the biasing force may pull the first end 241 of the second set of lifting members 240 towards the back board 204, thereby causing the second set of lifting members 240 to rotate about the lifting member first end 241 thereof. In this manner, the biasing member 262 may facilitate or assist the user in lifting or raising the bed frame 230 230 and, thereby the bed 10*a* (e.g., the box spring 30*a* and/or the mattress 20*a*) positioned thereon upwards off the surface on which the plurality of base plates 202 are positioned.

A tensioning member 263 may be operatively coupled to the biasing member 262. The tensioning member 263 may be configured to adjust the biasing force of the at least one biasing member 262. For example, the tensioning member 263 may include a slidable or otherwise movable coupling. The tensioning member 263 may be configured to move the coupling location of the biasing member first end closer or further away from the biasing member second end. This may adjust a tension in the biasing member 262 (e.g., a tension spring) by extending or shortening a length of the biasing member 262, thereby adjusting a biasing force exerted by the biasing member 262 on the second set of the lifting members 240.

The lifting assembly 210 may also include a plurality of cross-members 250 coupled to and positioned diagonally to opposing lifting members 220/240. The cross-members 250 may provide structural rigidity and mechanical support to the lifting members 220/240 for lifting the bed frame 230, and thereby the bed 10*a* off the surface.

In some embodiments, a length of each of the plurality of cross-members 250 may be adjustable so as to adjust a spacing between the opposing lifting members 220/240 to correspond to a width of the bed frame 230, and thereby the bed 10*a* positioned thereon. For example, the plurality of cross-members 250 may allow adjusting a spacing between opposing lifting members 220/240 such that the lifting assembly 210 may be usable with any bed frame (e.g., the bed frame 130/230), and/or bed (e.g., the bed 10/10*a*).

In other embodiments, the length of the cross-members 250 may be fixed and selected to correspond to a width of a particular bed frame 230. In such embodiments, the lifting assembly 210 may be integrated with the bed frame 230.

Figure 5:
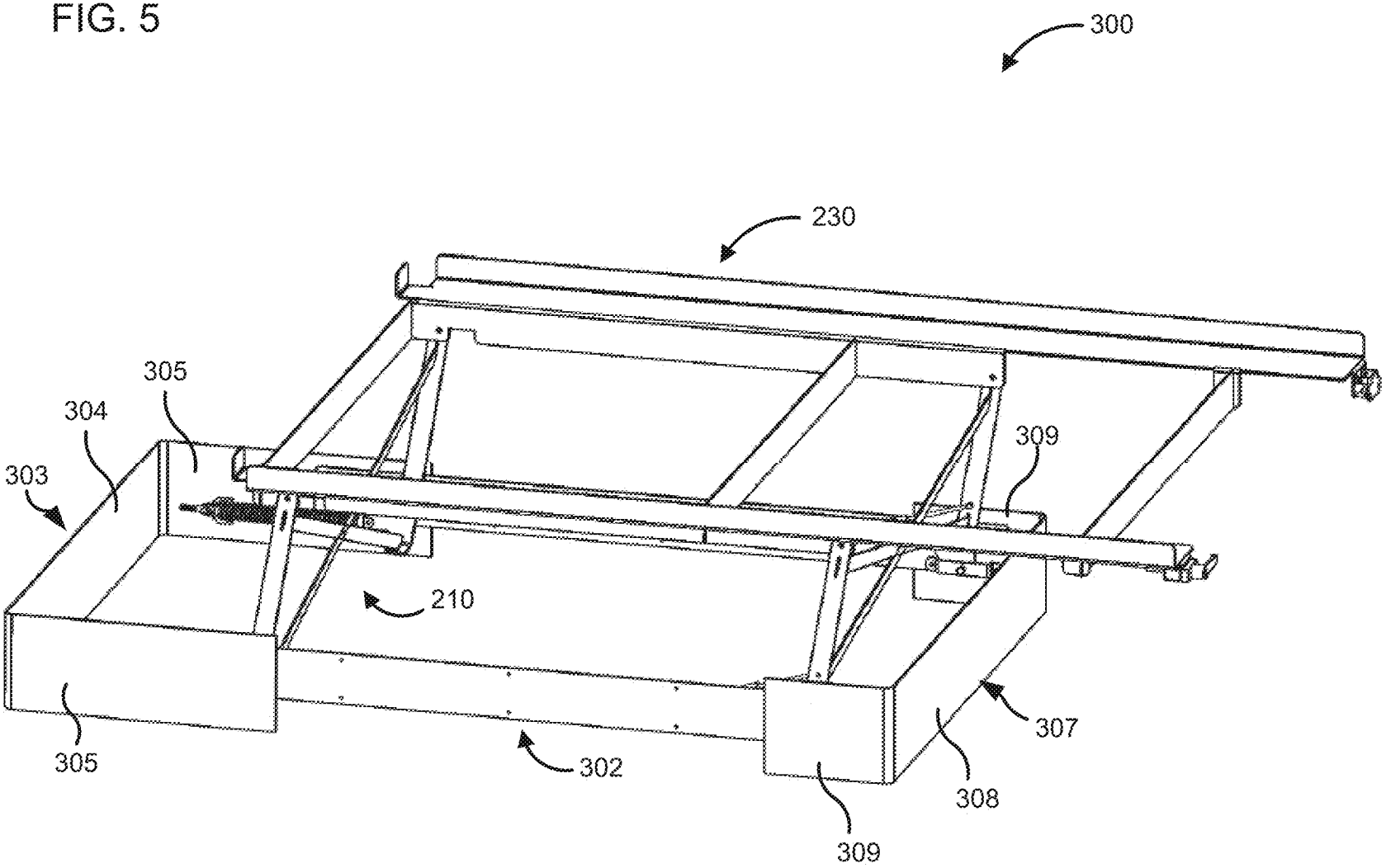
FIG. 5 is a top, front, right perspective view of another embodiment of an apparatus which includes the lifting assembly of FIG. 2 coupled to an embodiment of a plurality of base plates.

FIG. 5 is a perspective view of yet another embodiment of apparatus 300 that includes the lifting assembly 210 as described before with respect the apparatus 200 coupled to a the bed frame 230, as described before and a plurality of base plates 302. A bed (e.g., the mattress 20/20*a* and optionally, a box spring e.g., the box spring 30/30*a*) may be positioned on at least a portion of the bed frame 230, as previously described. While, FIG. 5 shows the lifting assembly 210 in the second configuration as described previously herein, the lifting assembly 210 is movable between the first configuration and the second configuration so as to lift or raise the bed frame 230 and, thereby a bed positioned thereon, off a surface on which the apparatus 300 is positioned, as described with respect to the apparatus 200.

The plurality of base plates 302 include a pair of base plates 302 positioned opposite to each other and configured to be positioned on a surface, for example a floor. The plurality of base plates 302 include flat plates formed from a strong and rigid material (e.g., metals such as cast iron or stainless steel). The base plates 302 may be substantially similar to the base plates 202 and, therefore not described in further detail herein.

The apparatus 300 also includes a first plate 303 and a second plate 307. The first plate 303 includes a first plate cross member 304 and a pair of first plate coupling members 305. A first end of each of the first plate coupling members 305 is coupled to an opposing end of the first plate cross-member 304. Furthermore, a second end of each of the first plate coupling members 305 is coupled to a base plate first end of a corresponding base plate 302.

Similarly, the second plate 307 includes a second plate cross member 308 and a pair of second plate coupling members 309. A first end of each of the second plate coupling members 309 is coupled to an opposing end of the second plate cross-member 308. Furthermore, a second end of each of the first plate coupling members 305 is coupled to a base plate second end of a corresponding base plate 302 opposite the base plate first end.

The base plates 302 may be coupled to the corresponding first plate coupling members 305 and/or the second plate coupling members 309 using any suitable method, for example fasteners (e.g., screws, nuts, bolts, rivets, pins, etc.). Each of the first plate coupling members 305 and/or the second plate coupling members 309 are oriented substantially parallel to the corresponding base plate 302 such that an edge of each of the first plate cross-member 304, the first plate coupling members 305, the second plate cross-member 308 and the second plate coupling member 309 contact the surface when the apparatus 300 is positioned on the surface as shown in FIG. 5.

Figure 6:
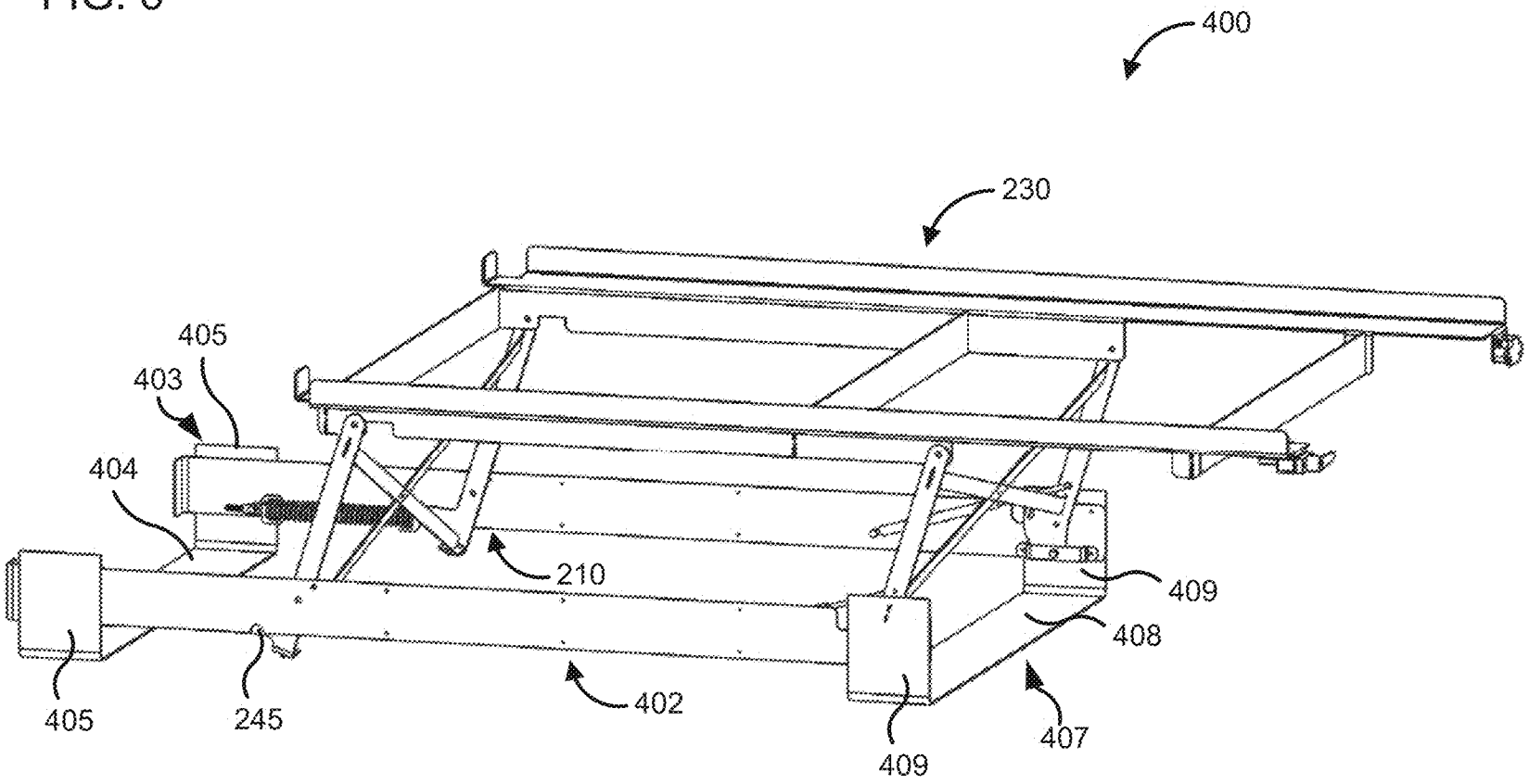
FIG. 6 is a top, front, right perspective view of still another embodiment of an apparatus that includes the lifting assembly of FIG. 2 coupled to another embodiment of base plates.

FIG. 6 is a perspective view of yet another embodiment of an apparatus 400 that includes the lifting assembly 210 as described before with respect the apparatus 200 coupled to the bed frame 230 (as described before) and a plurality of base plates 402. A bed (e.g., a mattress such as the mattress 20/20*a* and optionally, a box spring such as the box spring 30/30*a*) may be positioned on at least a portion of the bed frame 230, as previously described. While FIG. 6 shows the lifting assembly 210 in the second configuration as described previously herein, the lifting assembly 210 is movable between the first configuration and the second configuration so as to lift or raise the bed frame 230 and, thereby the bed positioned thereon off a surface on which the apparatus 400 is positioned, as described with respect to the apparatus 200.

The plurality of base plates 402 include a pair of base plates 402 positioned opposite to each other. The plurality of base plates 402 may be positioned on a surface, for example a floor. The plurality of base plates 402 include flat plates formed from a strong and rigid material (e.g., metals such as cast iron or stainless steel). The base plates 402 may be substantially similar to the base plates 202 and, therefore not described in further detail herein.

The apparatus 400 also includes a first plate 403 and a second plate 407. The first plate 403 includes a first plate cross member 404 and a pair of first plate coupling members 405. A first end of each of the first plate coupling members 405 is coupled to an opposing end of the first plate cross-member 404. Furthermore, a second end of each of the first plate coupling members 405 is coupled to a base plate first end of a corresponding base plate 402.

Similarly, the second plate 407 includes a second plate cross member 408 and a pair of second plate coupling members 409. A first end of each of the second plate coupling members 409 is coupled to an opposing end of the second plate cross-member 408. Furthermore, a second end of each of the first plate coupling members 405 is coupled to a base plate second end of a corresponding base plate 402 opposite the base plate first end.

The base plates 402 may be coupled to the corresponding first plate coupling members 405 and/or the second plate coupling members 409 using any suitable method, for example fasteners (e.g., screws, nuts, bolts, rivets, pins, etc.). Each of the first plate coupling members 405 and/or the second plate coupling members 409 are oriented substantially orthogonal (e.g., at angle in the range of 85 to 95 degrees) to the first plate cross-member 404 and the second plate cross-member 408, respectively as well as to the corresponding base plate 402. Each of the first plate cross-member 404 and the second plate cross-member are positioned flat on the surface so as to position the apparatus 400 on the surface.

Figure 7:
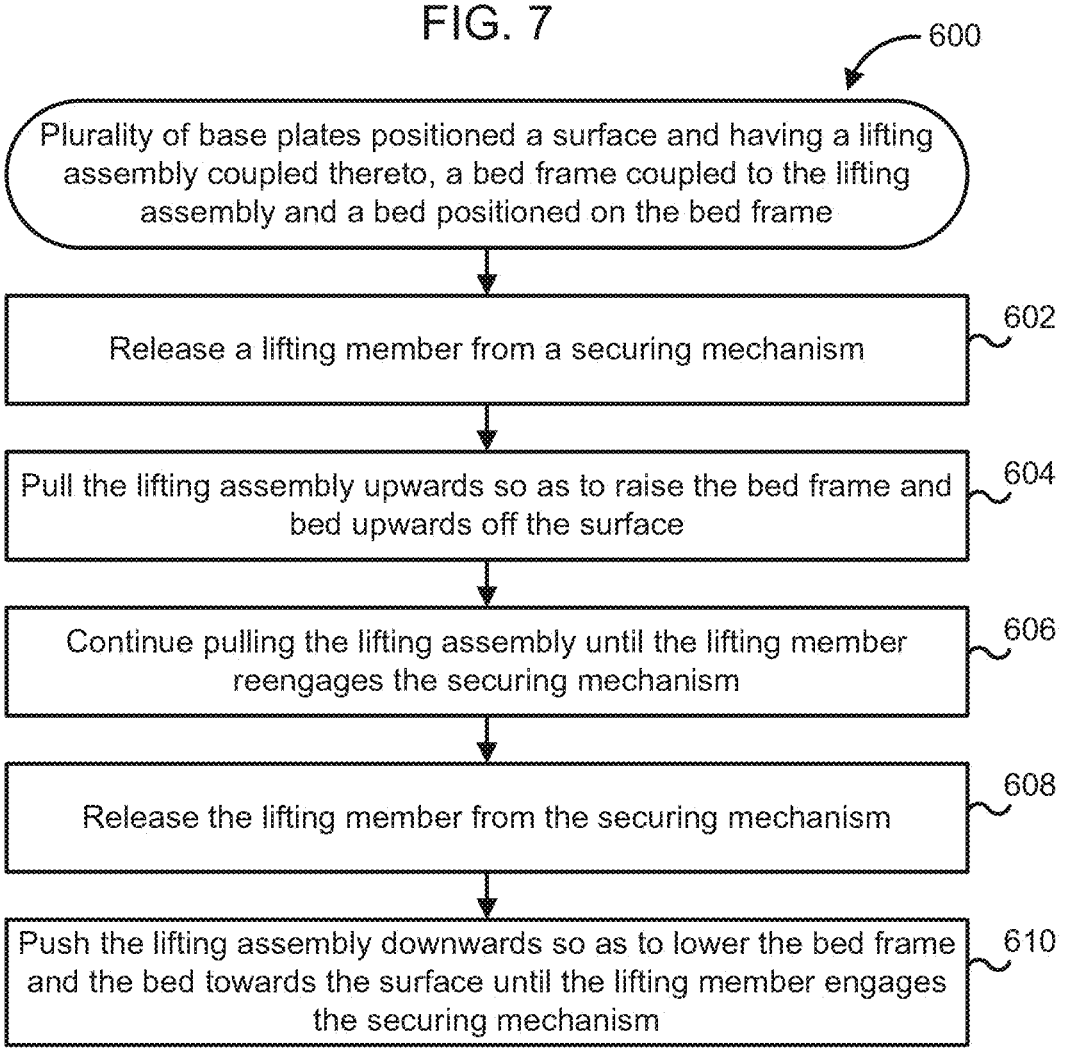
FIG. 7 is a schematic flow diagram of an example method for raising or lifting a bed frame and thereby, bed including a box spring and/or a mattress positioned on a surface, off the surface via a lifting assembly coupled to the bed frame and a plurality of base plates positioned on the surface.

FIG. 7 is a schematic flow diagram of an example method 600 for lifting or raising a bed frame (e.g., the bed frame 130/230) having a bed (e.g., the bed 10/10*a*) positioned thereon, off a surface, for example the floor. The bed frame is coupled to a lifting assembly (e.g., the lifting assembly 110/210) which is also coupled to a plurality of base plates (e.g., the base plates 102/202/302/402) positioned on a surface, for example the floor.

The method 600 includes releasing a lifting member of the lifting assembly from a securing mechanism at 602. For example, a user may engage a latch (e.g., the latch 266) and/or a knob (e.g., the knob 268) included in the lifting assembly (e.g., the lifting assembly 110/210/510) so as to release the lifting member (e.g., the first aperture 226 of the first set of lifting members 220) from the securing mechanism (e.g., the securing mechanism 229), as described herein.

The lifting assembly is pulled upwards so as to raise the bed frame, and thereby the bed, off the surface at 604. For example, the user may lift the plurality of rails 231 of the bed frame 230 and/or pull the plurality of rails 230 towards the front board 206 of the. This causes the lifting members 220/240 to rotate about the lifting member first end 221/241 and lift the bed frame 130/230 and thereby, the bed 10/10*a* positioned thereon upwards from the plurality of base plates 102/202/302/402, and thereby the surface on which the plurality of base plates 102/202/302/402 are positioned as described previously herein.

The upwards movement of the lifting assembly may be facilitated by at least one biasing member coupled to at least a portion of the lifting members. For example, the biasing member 262 may be coupled to the second set of lifting members 240 and exert a biasing force thereon, so as to facilitate lifting of at least a portion of the lifting assembly 210 upwards from the plurality of base plates 102/202/302/402, and thereby off the surface.

The lifting assembly is continued to be pulled upwards until the lifting member reengages the securing mechanism at 606. For example, the lifting assembly 110/210 is continued to be pulled upwards until the securing mechanism 229 engages the second aperture 228 of the first set of lifting members 220. A user may now change a bed sheet of the bed or otherwise make the bed without having to bend down.

To lower the lifting assembly, the lifting member is released from the securing mechanism at 608. For example, the user engages the latch 266 and/or the knob 268 so as to release the first set of lifting members 220 (e.g., the first aperture 226 of the first set of lifting members 220) from the securing mechanism 229. Once the first set of lifting members 220 is released, the weight of the box spring and/or the mattress may cause the lifting assembly 110/210 and thereby, the bed frame 130/230 to move downwards towards the plurality of base plates 102/202/302/402 and thereby the surface.

A damper 264 may be coupled to each of the first set of lifting members 220 so as to damp or resist the downwards motion of the lifting assembly 210 towards the bed frame 101/201/301/401/501. This may prevent slamming of the bed frame 130/230 which may result in injury to the user if a limb or the user is caught therebetween, or damage to the lifting assembly 110/210.

The lifting assembly is pushed downwards so as to lower the bed frame and the bed towards the surface until the lifting member engages the securing mechanism at 610. For example, the user may apply a downwards force on the bed 10/10*a* or the bed frame 130/230 so as to push the bed frame 130/230 and, thereby the bed 10/10*a* towards the surface.

The downwards force may be applied until the first set of lifting members 220 engages the securing mechanism 229, thereby securing the bed frame 130/230 proximate to the plurality of base plates 102/202/302/402 and, thereby the surface.

It should be noted that the term "example" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

It is important to note that the construction and arrangement of the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Additionally, it should be understood that features from one embodiment disclosed herein may be combined with features of other embodiments disclosed herein as one of ordinary skill in the art would understand. Other substitutions, modifications, changes and omissions may also be made in the design, operating conditions and arrangement of the various exemplary embodiments without departing from the scope of the present invention.

While this specification contains many specific implementation details, these should not be construed as limitations on the scope of any inventions or of what may be claimed, but rather as descriptions of features specific to particular implementations of particular inventions. Certain features described in this specification in the context of separate implementations can also be implemented in combination in a single implementation. Conversely, various features described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

What is claimed is:

1. An apparatus, comprising:

a plurality of base plates positioned on a surface;

a bed frame including a plurality of rails structured to receive a at least one of a box spring and a mattress thereon; and a lifting assembly coupled to each of the plurality of base plates and the bed frame, the lifting assembly comprising:

a plurality of lifting members, each of the plurality of lifting members having a lifting member first end and a lifting member second end, the lifting member first end pivotally coupled to at least one of the plurality of base plates at a first location of a corresponding base plate and the lifting member second end pivotally coupled to at least one of the plurality of rails of the bed frame at a second location of a corresponding rail;

a pair of cross-members coupled to and positioned diagonally to opposing lifting members of the plurality of lifting members, a first end of each of the pair of lifting members coupled to a first lifting member of the plurality of lifting members, a second end of each of the pair of cross-members coupled to a second lifting member that is opposite the first lifting member, the pair of cross-members coupled to each other and oriented diagonally relative to each other, a length of each of the plurality of cross-members being adjustable so as to adjust a spacing between the plurality of rails of the bed frame to correspond to a width of the mattress positioned on the plurality of rails, and a securing mechanism selectively securing at least a portion of the plurality of lifting members in a fixed position, wherein the lifting assembly is movable between a first configuration, in which the lifting member second end of each of the plurality of lifting members is positioned proximate to the plurality of base plates such that the plurality of rails of the bed frame, and thereby the bed positioned thereon, is positioned proximate to the surface, and a second configuration, in which the lifting member second end of the plurality of lifting members is positioned distal from the plurality of base plates so that the plurality of rails and, thereby the bed is raised off the surface, wherein as the lifting assembly moves from the first configuration to the second configuration, the lifting member first end of each of the plurality of lifting members remains at its corresponding first location on the corresponding base plate, and the lifting member second end of each of the plurality of lifting members remains at its corresponding second location on the corresponding rail such that the lifting member second end of each lifting member articulates about the corresponding lifting member first end, the articulation causing the plurality of rails, and thereby the bed frame, to be displaced vertically as well as horizontally relative to the plurality of base plates.

2. The apparatus of claim 1, wherein the securing mechanism is structured to fixedly secure the at least the portion of the plurality of lifting members in each of the first configuration and the second configuration.

3. The apparatus of claim 2, wherein at least the portion of the lifting members include a plurality of apertures, and wherein the securing mechanism includes a locking pin, the locking pin structured to engage at least one of the plurality of apertures in each of the first configuration and the second configuration so as to fixedly secure at least the portion of the lifting members.

4. The apparatus of claim 1, further comprising:

at least one of a latch and a knob, wherein the at least one of the latch and the knob are structured to be selectively engaged by a user so as to release at least the portion of the plurality of lifting members from the securing mechanism.

5. The apparatus of claim 4, further comprising:

a cable operatively coupling the at least one of the latch and the knob to the securing mechanism.

6. The apparatus of claim 1, further comprising:

at least one damper having a damper first end and a damper second end, the damper first end of the at least one damper coupled to a corresponding base plate of the plurality of base plates, and the damper second end of the at least one damper coupled to a first set of the plurality of lifting members, the at least one damper configured to exert a damping force on the second set of lifting members so as to limit a velocity of the lifting assembly as it is being moved from the second configuration towards the first configuration.

7. The apparatus of claim 1, further comprising:

at least one biasing member having a biasing member first end and a biasing member second end, the biasing member first end of the at least one biasing member coupled to a corresponding base plate of the plurality of base plates, and the biasing member second end of the at least one biasing member coupled to a second set of the plurality of lifting members, the at least one biasing member configured to exert a biasing force on the first set of lifting members so as to urge the lifting assembly towards the second configuration.

8. The apparatus of claim 7, further comprising:

a tensioning member operatively coupled to the at least one biasing member, the tensioning member configured to adjust the biasing force of the at least one biasing member.

9. A lifting assembly comprising:

a plurality of lifting members configured to be coupled to a plurality of base plates positioned on a surface and a bed frame configured to receive a bed thereon, the bed frame including a plurality of rails, each of the plurality of lifting members having a lifting member first end and a lifting member second end, the lifting member first end configured to be pivotally coupled to the plurality of base plates at a first location of a corresponding base plate, and the lifting member second end pivotally coupled to at least one of the plurality of rails of the bed frame at a second location of a corresponding rail;

a pair of cross-members coupled to and positioned diagonally to opposing lifting members of the plurality of lifting members, a first end of each of the pair of lifting members coupled to a first lifting member of the plurality of lifting members, a second end of each of the pair of cross-members coupled to a second lifting member that is opposite the first lifting member, the pair of cross-members coupled to each other and oriented diagonally relative to each other, a length of each of the plurality of cross-members being adjustable so as to adjust a spacing between the plurality of rails of the bed frame to correspond to a width of a mattress positioned on the plurality of rails; and a securing mechanism selectively securing at least a portion of the plurality of lifting members in a fixed position, wherein the lifting assembly is movable between a first configuration, in which the lifting member second end of each of the plurality of lifting members is positioned proximate to the plurality of base plates such that the plurality of rails of the bed frame, and thereby the bed positioned thereon, is positioned proximate to the surface, and a second configuration, in which the lifting member second end of each of the plurality of lifting members is positioned distal to the plurality of base plates so that the plurality of rails of the bed frame and, thereby the bed positioned thereon is raised off the surface, wherein as the lifting assembly moves from the first configuration to the second configuration, the lifting member first end of each of the plurality of lifting members remains at its corresponding first location on the corresponding base plate, and the lifting member second end of each of the plurality of lifting members remains at its corresponding second location on the corresponding rail such that the lifting member second end of each lifting member articulates about the corresponding lifting member first end, the articulation causing the plurality of rails, and thereby the bed frame, to be displaced vertically as well as horizontally relative to the plurality of base plates.

10. The lifting assembly of claim 9, wherein the securing mechanism is structured to fixedly secure the at least the portion of the plurality of lifting members in each of the first configuration and the second configuration.

11. A bed lifting apparatus, comprising:

a plurality of base plates positioned on a surface;

a receiver structured to receive at least one of a box spring and a mattress thereon; and a lifting assembly coupled to each of the plurality of base plates and the receiver, the lifting assembly comprising:

a plurality of lifting members, each of the plurality of lifting members having a lifting member first end and a lifting member second end, the lifting member first end pivotally coupled to at least one of the plurality of base plates at a first location of a corresponding base plate and the lifting member second end pivotally coupled to the receiver at a second location of the receiver;

a pair of cross-members coupled to and positioned diagonally to opposing lifting members of the plurality of lifting members, a first end of each of the pair of lifting members coupled to a first lifting member of the plurality of lifting members, a second end of each of the pair of cross-members coupled to a second lifting member that is opposite the first lifting member, the pair of cross-members coupled to each other and oriented diagonally relative to each other, a length of each of the plurality of cross-members being adjustable so as to adjust a spacing between the plurality of rails of the bed frame to correspond to a width of the mattress positioned on the plurality of rails; and a securing mechanism selectively securing at least a portion of the plurality of lifting members in a fixed position, wherein the lifting assembly is movable between a first configuration, in which the lifting member second end of each of the plurality of lifting members is positioned proximate to the plurality of base plates such that the receiver, and thereby the bed positioned thereon, is positioned proximate to the surface, and a second configuration, in which the lifting member second end of the plurality of lifting members is positioned distal from the plurality of base plates so that the receiver and, thereby the bed is raised off the surface, wherein as the lifting assembly moves from the first configuration to the second configuration, the lifting member first end of each of the plurality of lifting members remains at its corresponding first location on the corresponding base plate, and the lifting member second end of each of the plurality of lifting members remains at its corresponding second location on the receiver such that the lifting member second end of each lifting member articulates about the corresponding lifting member first end, the articulation causing the receiver to be displaced vertically as well as horizontally relative to the plurality of base plates.

12. The bed lifting apparatus of claim 11, wherein the securing mechanism is structured to fixedly secure the at least the portion of the plurality of lifting members in each of the first configuration and the second configuration.

13. The bed lifting apparatus of claim 11, wherein at least the portion of the lifting members include a plurality of apertures, and wherein the securing mechanism includes a locking pin, the locking pin structured to engage at least one of the plurality of apertures in each of the first configuration and the second configuration so as to fixedly secure at least the portion of the lifting members.

14. The bed lifting apparatus of claim 11, further comprising:

at least one damper having a damper first end and a damper second end, the damper first end of the at least one damper coupled to a corresponding base plate of the plurality of base plates, and the damper second end of the at least one damper coupled to a first set of the plurality of lifting members, the at least one damper configured to exert a damping force on the second set of lifting members so as to limit a velocity of the lifting assembly as it is being moved from the second configuration towards the first configuration.

15. The bed lifting apparatus of claim 11, further comprising:

at least one biasing member having a biasing member first end and a biasing member second end, the biasing member first end of the at least one biasing member coupled to a corresponding base plate of the plurality of base plates, and the biasing member second end of the at least one biasing member coupled to a second set of the plurality of lifting members, the at least one biasing member configured to exert a biasing force on the first set of lifting members so as to urge the lifting assembly towards the second configuration.

* * * * *